US006294110B1

(12) United States Patent
Friswell et al.

(10) Patent No.: US 6,294,110 B1
(45) Date of Patent: Sep. 25, 2001

(54) COLOR CANCELING MARKING SYSTEMS

(75) Inventors: Michael R. Friswell; Al Zimin, Sr., both of Wayne; Peter A. Caputo, South Orange, all of NJ (US)

(73) Assignee: Rohm and Haas Company, Philadelphia, PA (US)

( * ) Notice: Subject to any disclaimer, the term of this patent is extended or adjusted under 35 U.S.C. 154(b) by 0 days.

(21) Appl. No.: 09/442,673

(22) Filed: Nov. 18, 1999

(51) Int. Cl.[7] ..... G01N 33/00

(52) U.S. Cl. ..... 252/408.1; 44/600; 436/56; 208/12

(58) Field of Search ..... 252/408.1, 364; 44/600, 378, 327; 436/27, 29, 56, 172; 534/653, 654; 8/521, 638, 639; 208/12; 106/31.14

(56) References Cited

U.S. PATENT DOCUMENTS

| | | | | |
|---|---|---|---|---|
| 4,209,302 | | 6/1980 | Orelup | 44/334 |
| 4,735,631 | | 4/1988 | Orelup | 44/428 |
| 4,904,765 | * | 2/1990 | Derber et al. . | |
| 5,142,030 | | 8/1992 | Zimin et al. | 534/649 |
| 5,156,653 | | 10/1992 | Friswell et al. | 44/328 |
| 5,205,840 | | 4/1993 | Friswell et al. | 44/428 |
| 5,252,106 | | 10/1993 | Hallisy | 44/328 |
| 5,490,872 | | 2/1996 | Friswell et al. | 44/328 |
| 5,737,871 | | 4/1998 | Friswell et al. | 44/328 |
| 5,905,043 | | 5/1999 | Heffron | 436/56 |
| 5,958,780 | * | 9/1999 | Asher et al. . | |
| 5,962,330 | * | 10/1999 | Frederico et al. . | |
| 6,002,056 | * | 12/1999 | Smith et al. . | |
| 6,007,744 | * | 12/1999 | Nacker . | |

* cited by examiner

*Primary Examiner*—William H. Beisner
(74) *Attorney, Agent, or Firm*—Kenneth Crimaldi

(57) ABSTRACT

Two or more dyes or markers, including a dye or marker having an absorbance peak in the 400 to 500 nm range and including a dye or marker having an absorbance peak in the 560 to 700 nm range are mixed together in appropriate ratios so when added to a liquid, such as a petroleum fuel, at combined levels of from 5 to 100 ppm, the colors of the dyes and/or markers cancel each other such that a "water-white" liquid still appears "water-white".

11 Claims, No Drawings

COLOR CANCELING MARKING SYSTEMS

The present invention is directed to marking systems for tagging colorless liquids, such as "water white" petroleum fuels or "water white" organic solvents with two dyes or markers which, at the levels used, each impart a slight color, the color of each of which is masked by the color of the other.

BACKGROUND OF THE INVENTION

It is well known to provide markers (taggants) and packages to the fuel industry to aid in identifying taxable vs. untaxed fractions, additive packages, brand identification, etc. Until recently, tax evaders exclusively mixed similar petroleum fractions, e.g.,. kerosene into #2 oil or heating oil into diesel fuel in order to avoid taxation. Recently, a new twist has emerged, where common solvents, e.g., xylene, toluene, naptha, etc. are being used as fuel diluents to avoid taxation.

For the supplier marker systems, this has brought about a new challenge. In the past, a number of tracer molecules such as described in U.S. Pat. Nos. 5,156,653, 5,490,872 and 5,737,871 have a pale yellow body color. Intrinsic color value of such tracer molecules was described in terms of known solid dye such as color index Yellow 56.

The slight yellow color imparted by such tracer molecules, at the application level of the tracer molecule in fuel, typically 5–50 ppm, was not considered a problem due to natural yellow coloration associated with most petroleum fractions. Consequently, these products were considered "silent" or not visibly detectable when applied in the proper manner.

Other potentially useful tracer molecules might impart a different color. For example, tracer molecules described in U.S. Pat. No. 4,209,302 imparts a purple color to petroleum fuels. However, if these molecules were used in conjunction with a petroleum dye intended to color the petroleum fuel, the color of the tracer molecule used, e.g., at a 5–50 ppm level, would be masked. In this sense, these molecules could be considered "silent" in that a potential cheater would not recognize the inclusion of the tracer molecule.

Tagging of water white solvents at the current normal dosage levels, e.g., 5–50 ppm, with colored tracer molecules imparts a definite coloration to the such solvents. This is unacceptable to the governments, solvent manufacturers and consumers of these products for a variety of reasons. Governments reject imparted color due to existing regulations for such goods requiring A.P.H.A. or Sarbolt color measurements of zero. Also, the integrity of a government sponsored program is compromised because imparting color to traditionally water white substances would immediately signal to the cheater and remove the element of surprise. The consumer would equate coloration of these products with poor quality or contamination making manufacturers adamant about maintaining current standards for body color.

SUMMARY OF THE INVENTION

In accordance with the invention there is provided a plural component marking system for colorless liquids, particularly colorless water-immiscible liquids such as "water white" petroleum fuels or "water white" organic solvents potentially used as adulterants for petroleum fuels. The marking system uses two or more markers and/or dyes at appropriate relative concentrations such that the combination of colors is a grey, which at the low use levels is undetectable to the naked eye and thus leaves the liquid within the standards of "water white". The grey color of the combination of markers and/or dyes is achieved by balancing of red, blue, and yellow color factors. A single marker or dye may provide more than one color factor; for example, a purple dye may contribute both blue and red color factors. A common dye color for petroleum fuels is purple, and a purple dye in combination of a yellow marker may be combined to provide a grey color combination. One or more of the markers and/or dyes may be used to identify the liquid. The combined level of markers and/or dyes used to tag a liquid in accordance with the invention is between about 5 and about 100 ppm.

DETAILED DESCRIPTION OF CERTAIN PREFERRED EMBODIMENTS

Herein, "ppm" is used conventionally as parts per million by weight.

The plural component systems according to the invention includes chemicals conventionally used as "dyes" and chemicals conventionally used as "markers". The term "dyes" is used conventionally in respect to petroleum fuels as colorants for the fuel while the term "marker" is intended to refer to chemicals which tag the fuel but which are sufficiently invisible to the naked eye and/or masked by a dye so as to be non-detectable in the petroleum fuel until extracted from the petroleum fuel and identified, e.g., by a chromophoric reaction. However, the distinction is somewhat blurred because certain "dyes", when used at a sufficiently low level, may serve as markers which may be identified by extraction. Also, certain "markers" which were originally intended to be identified by extraction and chromophoric reaction may be identified directly in the petroleum fuel by spectrophotometric methods, e.g., with a Petrospec® detection apparatus sold by Boston Advanced Technologies.

Although, heretofore, many chemicals used as "markers" were identified as "silent" or "colorless" at their intended tagging levels, many such chemicals in fact exhibit a slight color even at their intended use levels. Heretofore, natural yellow colors in certain petroleum fuels could be relied upon to "mask" a slight yellowish color of a marker. Alternatively, dyes intended to impart color to petroleum fuels would mask the color of low levels of marker compound. The number of suitable entirely colorless markers suitable for tagging "water white" liquids is quite limited.

Also, although a wide number of chemicals have been described as suitable "markers" for petroleum fuels, only a relatively small proportion of these are commercially viable and actually used as petroleum markers. The number of commercially viable markers is further reduced by the stricter standards for "water white" liquids. With a wide variety of tax structures, brand names, and possible adulterants, there exists a need for additional marking systems, particularly for "water white" liquids.

Surprisingly, it is found that a blue-to-purple component (s), typically having an absorbency peak in the 600–700 nm range, and a yellow component(s), typically having an absorbency peak in the 400–500 nm range, may mutually mask their color, the combination appearing "grey" to the naked eye and thus undetectable by the naked eye at the total intended use level of between about 5 and about 50 ppm.

Actual combinations of colored components must be determined empirically from available markers and dyes. Also, the relative proportions of two components must be empirically determined according to their color intensity. However, such empirical determination is within the scope of the art.

Compounds generally thought of as "markers" are generally extractable with an aqueous solution, either alkaline or acidic, depending upon the chemical nature of the "marker". Chromophoric reaction may be with the base or acid of the extracting solution or with a color developing compound, e.g., a diazo reactant for an aniline marker as described in U.S. Pat. No. 4,209,302. Any such extractable marker, when used as part of a plural component system in accordance with the invention may be similarly identified as heretofore described. Both extractable markers and non-extractable dyes may also be detected spectrophotometrically as described above. Accordingly a variety of suitable combinations are possible including:

| first component | second component |
|---|---|
| a non-extractable dye | a non-extractable dye |
| an alkaline aqueous extractable marker | a non-extractable dye |
| an acidic aqueous extractable marker | a non-extractable dye |
| an acidic aqueous extractable marker | an alkaline aqueous extractable marker |

A third, forth, etc. component(s) selected from any of the above-mentioned types may be added for color balancing. Most systems in accordance with the invention, however, will be limited to a combination of two to three markers and/or dyes. It is to be understood, however, that many markers and dyes are, due to their method of synthesis, actually a mixtures of several related chemical compounds. If one of the components is to be identified by extraction, either acidic aqueous or alkaline aqueous, the extractant should not extract any of the other components of the color mixture.

Examples of components absorbing in the 560 to 700 nm range include:

Non Extractable Dyes

Solvent Blue 98

Solvent Blue 79

Alkaline Aqueous Extractable Marker 1-akyl amino-4-hydroxy 9,10 Anthracenedione

Examples of components absorbing in the 400 to 500 nm range include:

Non Extractable Dyes 1-phenyl-3-methyl-4-(alkylphenylazo)-5-pyrazalone

Solvent Yellow 107

Solvent Yellow 96

Solvent Yellow 174

Solvent Yellow 124

Solvent Yellow 56

Acidic Aqueous Extractable Marker 4-(2-methoxyphenylazo)-1-(3-methoxypropyl-amino) naphthalene alkaline aqueous extractable markers Phenol, 2,6 Bis(1-methyl-propyl-4-[4-nitro phenyl]-azo Phenol, 2,6 Bis(1-methyl propyl)-4-[2-nitro phenyl]-azo Phenol, 2,6 Bis(1-methyl-propyl)-4-[3,4di chloro phenyl]-azo Phenol, 2,6 Bis(1-methyl-propyl)-4-[2-chloro-4nitro phenyl]-azo Disazo dye; phenylazo-n-phenylazo-phenyl-benzamide, alkyl derivative Additional examples of marker components for plural component systems in accordance with the invention can be found for example, in U.S. Pat. Nos. 4,209,302, 4,735,631, 5,156,653, 5,205,840, 5,252,106, 5,490,872, 5,737,871, 5,905,043, the teachings of each of which are incorporated herein by reference. Additional examples of dyes useful in the invention can be found in U.S. Pat. No. 5,142,030, the teachings of which are incorporated herein by reference. Again, because achieving a grey is dependent upon color factors of the dye, including blue, yellow, and red color factors, color balancing is empirical. The empirical color balancing may also take into account any color factors naturally occurring in the liquid, e.g., yellow impurities in petroleum fuel.

While a yellow marker or dye is best masked with a blue or purple, in some cases a red dye, such as Solvent Red 164 having a maximum absorbance peak at about 520 nm may be added as well.

In accordance with one aspect of the invention when an alkaline extractable marker is used in conjunction with a non-extractable dye in a petroleum fuel, the specimen is desirably first extracted with an acidic aqueous solution to remove any yellow colored impurities. Thereafter, the marker may be extracted with alkaline aqueous solution and identified in a conventional manner.

The invention will now be described in greater detail by way of specific examples:

EXAMPLE 1

A blend of (A) phenol, 2,6-bis(1-methyl propyl-4-[4-nitro phenyl]azo, an amine-extractable molecule described in Example 1 of U.S. Pat. No. 5,156,653; (B) Solvent Red 164; and (C) Solvent Blue 98 at a 94:2.04:3.96 weight ratio is added at 10 ppm total to xylene. Color is undetectable.

EXAMPLE 2

A blend of (A), the reaction product of phenyl-ethyl ethanolamine and diazotized aniline described in Examples 1 and 2 of U.S. Pat. No. 5,737,874; (B) Solvent Blue 98; and (B) Solvent Red 164 are mixed at a weight ration of 80:13.4:6.6. At 10 ppm total in xylene, color is undetectable. Compound (A) is extractable in acidic aqueous solution.

What is claimed is:

1. A mixture of at least a first colored component and a second colored component blended at such ratio that said mixture dissolved in a colorless liquid at between 5 and 100 ppm does not impart color to said colorless liquid due to color canceling of color factors in the components of said mixture.

2. The mixture according to claim 1 wherein said mixture comprises a colored component having an absorbency peak in the 400–500 nm range and a colored component having an absorbency peak in the 560–700 nm range.

3. The mixture according to claim 1 wherein said mixture is soluble in a petroleum fuel.

4. The mixture according to claim 3 wherein one of said components is extractable from a liquid in which it is dissolved in a manner which does not extract other components of said mixture.

5. The mixture according to claim 4 wherein one of said components is extractable in alkaline aqueous solution.

6. The mixture according to claim 5 wherein one of said components is extractible in acidic aqueous solution.

7. The mixture according to claim 4 wherein one of said components is extractable in acidic aqueous solution.

8. The mixture according to claim 7 wherein one of said components is extractable in alkaline aqueous solution.

9. The mixture according to claim 7 wherein one of said components is a non-extractable dye.

10. The mixture according to claim 1 wherein one of said components is extractable from a liquid in which it is dissolved in a manner which does not extract other components of said mixture.

11. A mixture of at least a first colored component and a second colored component blended at such ratio that said mixture dissolved in a colorless liquid at between 5 and 100 ppm does not impart color to said colorless liquid due to color canceling of color factors in the components of said mixture;

wherein said mixture is soluble in a petroleum fuel;

wherein one of said components is extractable from a liquid in which it is dissolved in a manner which does not extract other components of said mixture;

wherein one of said components is extractable in alkaline aqueous solution; and wherein one of said components is a non-extractable dye.

* * * * *